United States Patent [19]

Jann

[11] Patent Number: 4,540,148

[45] Date of Patent: Sep. 10, 1985

[54] CHAIR HEIGHT ADJUSTMENT MECHANISM

[76] Inventor: James M. Jann, 1650 Glenforest, Ada, Mich. 49301

[21] Appl. No.: 550,625

[22] Filed: Nov. 10, 1983

[51] Int. Cl.[3] ..... F16M 11/00

[52] U.S. Cl. ..... 248/406.2; 188/67; 248/410

[58] Field of Search ..... 248/406.1, 406.2, 405, 248/410, 412, 413, 415, 416, 417, 418, 157; 297/348, 345; 180/67; 192/4 R

[56] References Cited

U.S. PATENT DOCUMENTS

| | | | |
|---|---|---|---|
| 2,058,451 | 10/1936 | Herold . | |
| 2,137,178 | 11/1938 | Merivaara . | |
| 3,727,871 | 4/1973 | Harper . | |
| 3,799,486 | 3/1974 | Mohr et al. | 248/406.1 |
| 3,870,271 | 3/1975 | Bowman . | |
| 3,923,280 | 12/1975 | Good | 248/415 |
| 4,261,540 | 4/1981 | Baker et al. . | |
| 4,285,488 | 8/1981 | Hancock | 248/405 |
| 4,324,382 | 4/1982 | Beukema et al. . | |
| 4,440,372 | 4/1984 | Wisniewski | 248/406.2 |

FOREIGN PATENT DOCUMENTS

| | | | |
|---|---|---|---|
| 2028118 | 3/1980 | United Kingdom | 248/405 |

*Primary Examiner*—Ramon S. Britts
*Assistant Examiner*—Ramon O. Ramirez
*Attorney, Agent, or Firm*—Varnum, Riddering, Schmidt & Howlett

[57] ABSTRACT

A chair height mechanism in which a threaded nut (30) is threaded onto a threaded spindle (16) and a hub tube (18) supports the spindle through a clutch comprising a locking tube (34) secured to the nut (30) and having lower tapered portion (36), and a cylindrical liner (46) secured to the hub tube and having an upper tapered outer surface (48) which mates with the cylindrical liner (46) inner surface. A compression spring (42) biases the tapered surfaces of the liner (46) and the locking tube (34) into engagement.

15 Claims, 5 Drawing Figures

CHAIR HEIGHT ADJUSTMENT MECHANISM

FIELD OF THE INVENTION

This invention relates to chair height mechanisms and in particular to chair height adjustment mechanisms in which a chair height is adjustable by rotation of the chair seat when unoccupied but is not adjustable by rotation of the seat when the chair is occupied.

STATE OF THE PRIOR ART

It is common for chair height mechanisms to provide a means for adjusting the height of the chair seat when the seat is unoccupied and further for such mechanisms to be ineffective for adjusting the height when the chair is occupied. This latter features prevents "piano-stooling" or inadverntent vertical adjustment of the chair in use. Examples of such mechanisms are found in the following U.S. Pat. Nos.:

Herold—2,058,451 issued Oct. 27, 1936
Merivaara—2,137,178 issued Nov. 15, 1938
Harper—3,727,871 issued Apr. 17, 1983
Bowman—3,870,271 issued Mar. 11, 1975
Baker et al—4,261,540 issued Apr. 14, 1981
Beukema et al—4,324,382 issued Apr. 13, 1982

In these chair height mechanisms, adjustment functions are provided by a clutch between a nut threaded onto a threaded spindle and a hub or base so that the clutch is engaged when the chair is unoccupied and disengaged when the chair is occupied. The more recent developments in these mechanisms have provided interlocking lugs between the nut and a washer which is coupled to the base. For firm engagement, it usually requires vertical movement of a quarter of an inch or so. This movement provides a cushioning effect but may also be undesirable for the occupant. Coil springs typically bias the clutch into an engagement position and may be fully compressed or close to it when the clutch is in the disengaged position. Extensive travel of the spring may result in fatigue failure of the spring, especially when the spring cycles through a fully compressed position.

Merivaara took a slightly different approach. The threaded nut in Merivaara has a conical upper surface which mates with a downwardly flared collar on the upper part of a tube. The bottom of the tube mounts a bearing with a conical receiving surface which mates with projecting fingers on the bottom of the nut. A coil spring between the bearing and the nut biases the nut into engagement with the collar on the upper portion of the tube. This arrangement requires a hub tube of a diameter slightly wider than the nut and would require a relatively wide shroud tube to cover this hub tube and burn-back areas resulting from welding the hub tube to the base. Further, the nut and bearing are relatively complex and more expensive than some of the more modern approaches. Current design philosophy is that the hub tube should be as small a diameter as possible to render the chair support as streamlined as possible. Thus, the Merivaara chair height mechanism does not appear to comport with current design philosophy.

SUMMARY OF THE INVENTION

According to the invention, a simple, durable and effective chair height mechanism is provided with an adjusting mechanism in which a relatively slight movement of the chair is required to engage and disengage the adjustment mechanism. A standard size common spindle can be used and the overall finished appearance of the mechanism is sleek and modern.

The chair height mechanism according to the invention has a nut threaded onto a threaded spindle. A clutch selectively couples the nut to a hub tube to adjust the axial height of the spindle with respect to the hub tube. Means bias the clutch into engagement relationship between the hub tube and the nut so that the spindle is adjustable with respect to the hub tube when a chair attached to the spindle is unoccupied and not adjustable when the chair is occupied.

According to the invention, the clutch comprises a cylindrical locking tube which is secured to the nut and extends downwardly thereof. A portion of the locking tube forms an inwardly-tapering locking surface beneath the nut. The hub tube includes a cylindrical wedge member telescopingly received within the locking tube, the wedge member having a flared outer surface complementary in shape to the tapered locking surface of the locking tube. Thus, slight upward movement of the wedge member with respect to the locking tube disengages the clutch means and the clutch means is engaged by a slight downward movement of the wedge member with respect to the locking tube.

The angle between the axis of the spindle and an element of the locking surface can vary but is preferably very slight so that a good gripping action occurs due to the frictional relationship between the wedge member and locking tube. It has been found that this angle can be in the range of 3°-10° and preferably about 7° for an effective chair height mechanism. When an angle of about 7° is used, the distance which the locking tube moves with respect to the wedge member is relatively slight, less than $\frac{3}{8}$ of an inch and can be as small as 0.010 of an inch.

The biasing means comprises first and second washers which are positioned between the nut and the cylindrical wedge member respectively. A compression spring biases the first and second washers apart. A friction means is provided between the first washer and the nut to lock the nut to the first washer when the clutch is disengaged. Means are provided to prevent rotation between the first washer and the spindle so that the nut is locked to the first washer to rotate with the spindle when the clutch is disengaged.

In a preferred embodiment of the invention, the first washer has a depending cylindrical portion which extends down along the spindle.

An annular metal bushing is concentrically mounted between the wedge member and the spindle to provide a bearing support for the spindle. With this annular metal bushing, the wedge member can be made of a plastic material.

In a preferred form of the invention, a cylindrical sleeve is mounted concentrically on the locking tube and extends substantially below the locking tube. A shroud tube is slidably mounted to the hub tube and is concentrically positioned between the hub tube and the cylindrical sleeve to cover the hub tube.

BRIEF DESCRIPTION OF THE DRAWINGS

The invention will now be described with reference to the accompanying drawings in which.

DESCRIPTION OF THE PREFERRED EMBODIMENT

Figure 2:
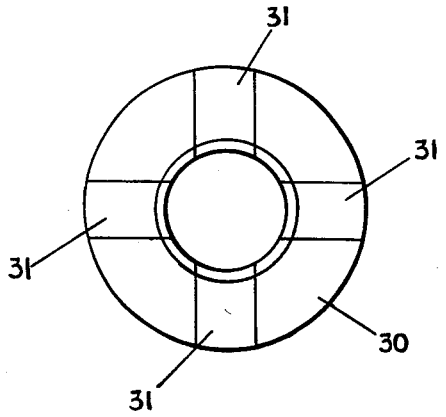
FIG. 2 is a plan view of a threaded nut used in the height adjustment mechanism shown in FIG. 1.
Figure 3:
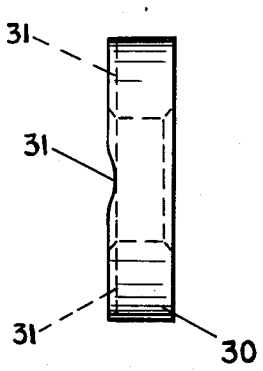
FIG. 3 is a side view of the nut shown in FIG. 2.

Referring now to the drawings, there is shown a portion of a hub 12 of conventional design with a central opening 13. A height adjustment mechanism 14 is secured to the hub assembly through a cylindrical hub tube 18. The hub tube 18 may be welded or press-fit into the central opening 13 of the hub 12. A spindle 16 is received within the hub tube 18. A shroud tube 20 is mounted in spaced relationship to the hub tube 18 on the hub 12 through a pair of O-rings 22 and 24. A cylindrical cover 26 having a radial flange 28 is received concentrically about and in spaced relationship to the shroud tube 20. The spindle 16 is adapted to be conventionally mounted nonrotatably to a chair seat (not shown) through a conventional chair iron (not shown). The spindle 16 is threaded on its outer surface through most of its length and has a retainer ring 32 in a groove in the upper portion thereof to limit upward movement along the spindle of a threaded nut 30 which is threaded onto the threads of the spindle 16. The threaded nut 30 has indentations 31 radially spaced about the bottom surface thereof (see FIGS. 2 and 3). The radial flange 28 of the cylindrical cover 26 rests on top of the threaded nut 30 and is preferably secured thereto for movement vertically therewith. The indentations 31 are used to secure the movement of nut 30 when locking tube 34 is crimped over nut.

Figure 4:
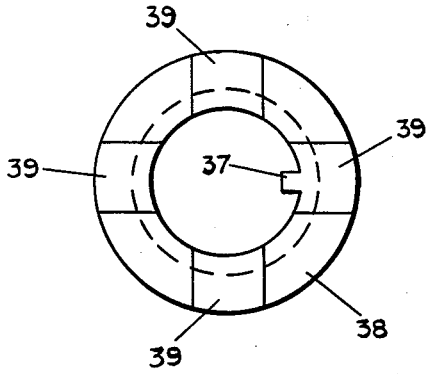
FIG. 4 is a plan view of a spring spacer used in the height adjustment assembly shown in FIG. 1.
Figure 5:
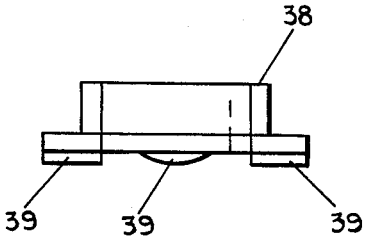
FIG. 5 is a side elevational view of the spring spacer shown in FIG. 4.

A locking tube 34 has a lower tapered portion 36 which forms an inner tapered surface and is secured to the nut 30. To this end, the nut 30 fits into a groove 35 in the upper end of the locking tube 34 and the top of the locking tube is bent over the top of the nut 30 to capture the nut 30 in the upper portion of the locking tube 34. An upper spring spacer washer 38 having radial raised bosses 39 on the upper surface thereof (FIGS. 4 and 5) is mounted on the spindle 16 beneath the nut 30. The spring spacer washer 38 has a key 37 which engages a longitudinal slot 17 of the spindle 16. A flat washer 40 has a key which engages the longitudinal slot 17 of the spindle 16 and is mounted beneath the compression spring 42. As seen in FIG. 5, the spacer washer 38 has an outwardly-extending radial flange at one end thereof which forms a spring holder for a compression spring 42. Thus, the spring spacer washer 38 and the washer 40 are biased away from each other by the spring 42.

A cylindrical liner 46, constructed of plastic material, has a tapered outer surface 48 at an upper portion thereof. The tapered outer surface 48 is complementary to the inner surface of the tapered lower portion 36 of locking tube 34. The cylindrical liner 46 has a cylindrical lower portion 50 which is received tightly and nonrotatably within the hub tube 18. An annular liner bushing 44 of metal is positioned within an annular groove in the upper portion of liner 46.

The lower portion 50 of the cylindrical liner 46 and the metal bushing 44 provide a long, low friction cylindrical bearing surface for the spindle 16. This bearing surface provides lateral stability for the spindle and reduces torsional stress on the nut 30.

Figure 1:
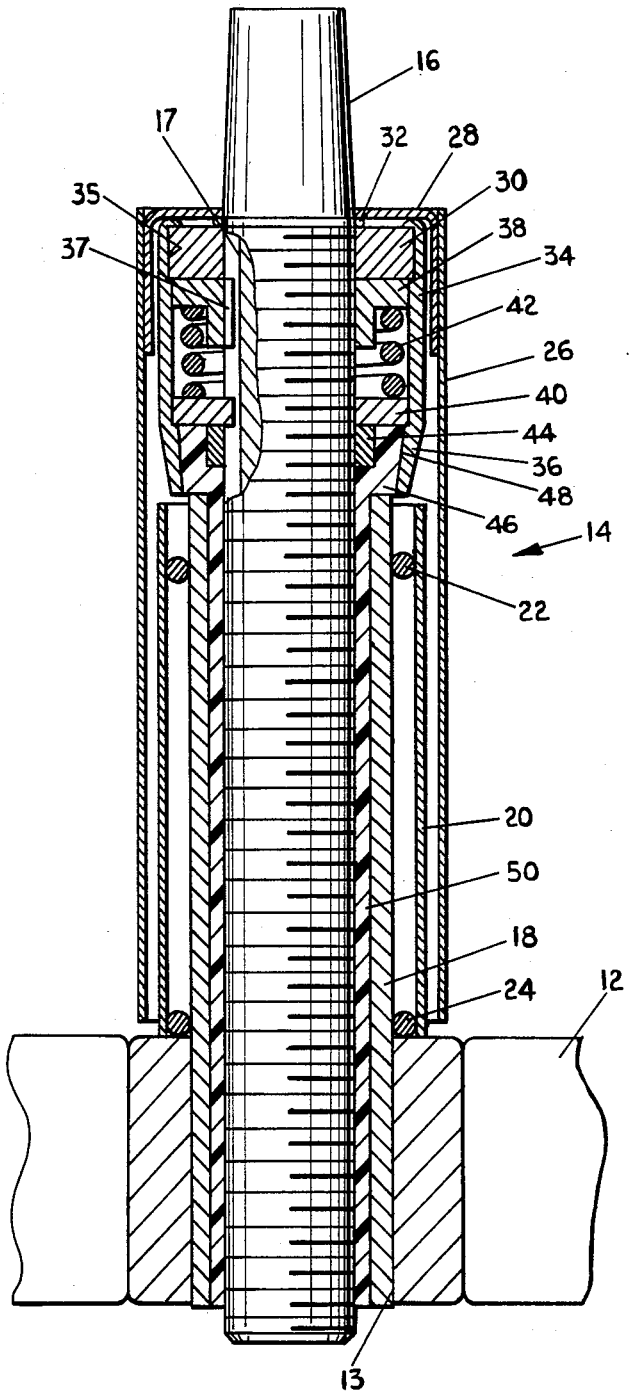
FIG. 1 is a sectional view through a height adjustment assembly according to the invention.

In operation, when the chair is unoccupied, it will assume the configuration shown in FIG. 1. In this condition, the threaded nut 30 will engage the spring spacer washer 38 through the raised bosses 39 on the washer 38 and the nut 30. Further, the threaded nut will be frictionally engaged with the cylindrical liner 46 through the locking tube 34. Thus, rotation of the spindle (by rotating the chair seat) will cause rotation of the spindle with respect to the threaded nut 30. Since the spring spacer washer 38 is keyed to the spindle 16, it will rotate therewith and with respect to the threaded nut 30. The frictional forces between the locking tube 34 and the cylindrical liner 46 exceed the forces of friction between the threaded nut 30 and the spring spacer 38. Thus, as the spindle 16 is rotated, the spindle will move upwardly or downwardly with respect to the nut 30.

The locking tube 34 and the cylindrical liner 46 form a clutch between the nut 30 and the hub tube 18. The interface between these two clutch members is the complementary tapered surfaces 48 and the inside of tapered portion 36. The angle of taper, as measured by the axis of the spindle 16 and an element of the tapered surface 48 or tapered portion 36, can vary somewhat. Generally, angles between 3° and 10° are suitable with about 7° being preferred.

When the chair is occupied, the spindle will be forced downwardly with respect to the hub 12. The threaded nut 30 will move downwardly with the spindle. This movement is sufficient to disengage the frictional engagement between the locking tube 34 and the cylindrical liner 46 due to the fact that the surfaces are at a low taper angle. When the chair is occupied, the clutch between the threaded nut 30 and the cylindrical liner 46 will be disengaged. Rotation of the spindle with respect to the hub when the chair is occupied thus will cause rotation of the spring washers 38 and 40 with the spindle. The threaded nut 30 will engage the raised bosses 39 of the spring spacer washer 38 so that the nut 30 will rotate with the spring spacer washer 38 as well as with the spindle 16. Thus, when the chair is occupied, rotation of the chair with respect to the hub causes no adjustment of the spindle with respect to the hub.

Thus, the invention provides an adjustable chair height mechanism whereby the height of the chair can be adjusted by rotating the chair with respect to the base while the chair is unoccupied and inadvertent height adjustment of the chair with respect to the base when the chair is occupied is avoided. The adjustment mechanism according to the invention provides a disengagement of the height adjustment mechanism by a very small movement of the chair with respect to the base, yet the locking mechanism is sure and efficient.

The chair height mechanism is simple, durable and effective in raising and lowering the seating. Raising and lowering the chair are provided by simply rotating the seat when the chair is unoccupied. The vertical adjustment is smooth and not ratcheted over a keyway washer bump. However, rotation of the seat when the chair is occupied disengages the adjustment mechanism and provides smooth rotation without bumping which is sometimes prevalent in other types of mechanisms. When the mechanism reaches the upper or lower limit of adjustment, continuing rotation does not affect, impair or destroy the action of the mechanism. The construction is durable in that it can use a full one-inch diameter spindle which is standard in the industry. The entire assembly can be constructed and reassembled in the factory with pre-established working clearances and no adjustment during assembly of the chair height mechanism to the chair is necessary. The assembly can be inserted into the tapered sleeve of a base or have legs welded directly to it. The tapered surfaces provide a built-in take-up adjustment for wear. The minimum working travel and preload on the spring provide a long-lasting and minimum-stress spring. If the spring does eventually break, the only impairment is the adjustability function. The chair will otherwise operate satisfactorily. The spindle liner is provided with a heavy wall thickness and the hub tube can also be provided with a fairly heavy wall thickness for durability.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. In a chair height adjustment mechanism wherein a nut is threaded onto a threaded spindle, a clutch selectively couples the nut to a hub tube for adjusting the axial height of the spindle with respect to the hub tube and means bias the clutch into engagement relationship between the hub tube and the nut so that the spindle is adjustable with respect to the hub tube when a chair attached to the spindle is unoccupied and the clutch is disengaged so that the relationship between the hub tube and the spindle is not adjustable when the chair is unoccupied;

the improvement in the clutch which comprises:

a cylindrical locking tube secured to said nut and extending downwardly thereof, a portion of said locking tube forming an inwardly tapering locking surface beneath said nut;

said hub tube including a cylindrical wedge member telescopingly received within said locking tube, said wedge member having a flared outer surface complementary to said tapered locking surface;

wherein slight upward movement of said wedge member with respect to said locking tube disengages said clutch and said clutch is engaged by slight downward movement of said wedge member with respect to said locking tube.

2. A chair height adjustment mechanism according to claim 1 wherein the angle between the axis of the spindle and an element of the locking surface is in the range of 3°–10°.

3. A chair height adjustment mechanism according to claim 2 wherein the angle between the axis of the spindle and an element in the locking surface is about 7°.

4. A chair height adjustment mechanism according to claim 2 wherein the biasing means comprises first and second washers positioned between the nut and the cylindrical wedge member respectively, and compression spring means to bias the first and second cylindrical washers apart.

5. A chair height mechanism according to claim 4 wherein the first and second washers abut the compression spring.

6. A chair height mechanism according to claim 5 and further comprising interengaging means between the first washer and the nut to lock the nut to the first washer when the clutch is disengaged.

7. A chair height mechanism according to claim 6 and further comprising means to prevent rotation between the first washer and the spindle so that the nut rotates with the spindle when the clutch is disengaged.

8. A chair height adjustment mechanism according to claim 7 wherein the first washer has a cylindrical portion which extends downwardly along the spindle.

9. A chair height adjustment mechanism according to claim 7 and further comprising an annular metal bushing concentrically mounted on the wedge member and in bearing relationship with the spindle.

10. A chair height mechanism according to claim 9 and further comprising a cylindrical sleeve mounted concentrically on the locking tube and extending substantially below the locking tube, and a shroud tube slidably mounted to the hub tube and concentrically between the hub tube and the cylindrical sleeve to cover the hub tube.

11. A chair height adjustment mechanism according to claim 10 wherein the angle of the axis of the spindle and an element of the locking surface is about 7°.

12. A chair height mechanism according to claim 1 wherein the biasing means comprises first and second washers positioned between the nut and the cylindrical wedge member respectively and compression spring means to bias the first and second washers apart.

13. A chair height adjustment mechanism according to claim 12 and further comprising friction means between the first washer and the nut to lock the nut to the first washer when the clutch is disengaged.

14. A chair height adjustment mechanism according to claim 1 and further comprising a cylindrical sleeve mounted concentrically on the locking tube and extending substantially below the locking, and a shroud tube slidably mounted to the hub tube and concentrically between the hub tube and the cylindrical sleeve to cover the hub tube.

15. A chair height adjustment mechanism according to claim 1 and further comprising an annular metal bushing concentrically mounted on the wedge member and in bearing relationship with the spindle.

* * * * *